United States Patent [19]

Friel

[11] Patent Number: 4,716,689

[45] Date of Patent: Jan. 5, 1988

[54] METHODS AND APPARATUS FOR KNIFE AND BLADE SHARPENING

[76] Inventor: Daniel D. Friel, Winward Rd., Greenville, Del. 19807

[21] Appl. No.: 855,147

[22] Filed: Apr. 23, 1986

Related U.S. Application Data

[63] Continuation-in-part of Ser. No. 588,794, Mar. 12, 1984, Pat. No. 4,627,194, and Ser. No. 588,795, Mar. 12, 1984, abandoned.

[51] Int. Cl.[4] ..... B24B 3/36

[52] U.S. Cl. ..... 51/285; 51/58; 51/353; 51/128; 51/326

[58] Field of Search ..... 51/57, 58, 60, 74 BS–92 BS, 51/108 BS, 98 BS, 109 BS, 116, 119, 128, 102, 6, 205 WG, 208, 210, 214, 241 G, 285, 170 MT, 227 H, 3 R, 326–327, 353–354

[56] References Cited

U.S. PATENT DOCUMENTS

| | | | |
|---|---|---|---|
| 890,658 | 6/1908 | Keiper | 51/116 |
| 2,635,398 | 4/1953 | Sohn | 51/227 H |
| 3,071,899 | 1/1963 | Hicks et al. | 51/128 |

*Primary Examiner*—Debra Meislin

*Attorney, Agent, or Firm*—Connolly & Hutz

[57] ABSTRACT

A knife or blade is sharpened by using an apparatus which includes a magnetic guide having a magnetic knife guide surface in a plane at an angle to and intersecting the abrasive surface to form a line of intersection therewith. The magnetic guide surface has north and south magnetic poles along lines substantially parallel to the line of intersection. One pole is along a portion of the guide surface remote from the abrasive surface and the other pole is along a portion of the guide surface contiguous to the abrasive surface.

9 Claims, 17 Drawing Figures

METHODS AND APPARATUS FOR KNIFE AND BLADE SHARPENING

CROSS REFERENCE TO RELATED APPLICATIONS

The application is a continuation in part of application Ser. No. 588,794, filed Mar. 12, 1984, now U.S. Pat. No. 4,627,194, and application Ser. No. 588,795, filed Mar. 12, 1984, now abandoned, the details of which are incorporated herein by reference thereto.

BACKGROUND OF THE INVENTION

This invention relates to a new and improved method and apparatus for rapidly sharpening knives and similar tools to create a superior cutting edge. As used herein, the term knife shall be defined to include any sort of blade such as chisels, plane edges, scissors, razor blades, and similar precision edges or cutting tools.

There are a wide variety of known means for sharpening knives some of which are discussed in the copending U.S. applications cited above. The large number and wide variety of existing means discussed in that application for sharpening knives is testimony to the complexity and difficulty of sharpening knives in a fast, convenient, and satisfactory-way that will consistently produce a sharp cutting edge. There is today in fact no known available means for the unskilled to produce rapidly and consistently razor-like cutting edges on knives.

Rapid sharpening requires a means to remove rapidly the material of composition of the knife—often a high carbon steel or a stainless steel. The rate of metal removal is related to the inherent hardness of the abrasive used, the particle size, or grit as it is commonly called, of the abrasive, the applied pressure on the knife edge, and the linear velocity of the abrasive particles across the edge being formed or sharpened. The hardest material commonly used for metal removal is diamond with a hardness of 10 on the Mohs' scale, compared to about 5.5 or so for many steel alloy knives. Other materials such as alumina, high density alpha alumina, carborundum, certain natural stones and the like also are harder than most steels and hence can be used for sharpening through abrasive action against the metal.

Creation of the finest cutting edges on the order of one tenthousandth (1/10,000) of an inch in width can be accomplished with these abrasive compositions, but a fine grit must be used and the velocity of the abrasive must be held below a critical limit to avoid overheating the thin and fine edge being created by the abrasive action. An abrasive system and apparatus designed to create fine edges such as that described in the copending applications cited above will remove metal at a rate lower than a system where the abrasive particles are larger and moving at higher velocities.

Because creation of the finest cutting edges involves inherently a slower metal removal rate, any process designed to create such edges is not optimum for the task of initial metal removal such as where a knife is first being formed or where the blade is particularly dull. Consequently, to reduce the total elapsed time needed with a very dull knife to create a thin and fine edge of a thickness limited only by the composition of knife and its crystalline structure, one usually resorts to a series of different and time consuming grinding and sharpening operations. None of the integrated sharpening equipment existent today are satisfactory for the rapid generation of fine edges on the order of 1/10,000 inch on otherwise very dull knives.

Much prior art has been concerned with disk type sharpeners for rapid sharpening such as described in U.S. Pat. No. 3,680,264. They have proved unsatisfactory because of serious control problems inherent with disks which manifest difficulties in positioning the knife accurately, in controlling the angular relationship of the knife with the disk face, and in creating excessive heating of the knife edge during sharpening. A most serious disadvantage has been the tendency of the disk to "grab" the knife when its edge is rested on the flat surface of the disk and to grind undesirable scallops or grooves along the knife edge in an uncontrolled manner. Such grabbing occurs if there is instability in the control of the angle that the knife face makes with the disk face, or inadequate means to hold the knife edge parallel to the flat surface of the disk, or poor control over the consistency of force applied to the knife edge by the disk or operator during sharpening.

A major cause of poor sharpening with disk sharpeners is poor control of knife angle relative to the rotating disk such as exemplified in prior art U.S. Pat. No. 2,496,139 that actually allows the knife guide to wobble and the sharpening angle to be determined more by operator skill or by the knife width and thickness. Poor control of the knife edge parallel to disk face or poor control of the angle of knife face relative to the principal plane of a disk sharpener is unacceptable if one wishes to optimize blade edge sharpness and to avoid gouging.

To minimize such uncontrolled gouging and grabbing of knives sharpened with disks, the prior art commonly has resorted to maintaining contact of the knife edge only with the corner edge of the disk such as described in U.S. Pat. No. 3,334,446 and deliberately avoiding a planar contact between the knife edge facet and the disk face perpendicular to its axis of rotation. In that patent the described disk is spring loaded to help reduce gouging and the knife is positioned on a rigid holder by means of a leaf spring pressing against the knife. A guiding means in this sharpener on one side of the disk edge limits the movement of the knife toward the disk. Even with these precautions, by deliberately avoiding planar contact with the disk face perpendicular to its axis of rotation there is only a point or limited line of contact between the blade and abrasive during sharpening and there is a strong tendency to gouge the knife edge. The abrasive passes the knife edge in essentially one fixed direction which leaves burrs and unacceptable large serrations on the blade edge.

A common version of this approach is described in U.S. Pat. No. 2,775,075 where the edge of the abrasive disk is beveled to enlarge the line of contact along that bevel of the knife edge with the abrasive. The tendency of such sharpeners to gouge knife blades is well known and at best the resulting knife edge is poorly defined and serrated. In all such sharpeners and abrasive passes the knife edge in essentially one fixed direction which creates the serrations and a sizeable burr on the knife edge.

A complex sharpener covered by U.S. Pat. No. 2,519,351 contains two pair, a total of four (4) abrasive blocks, one pair of which is biased to move toward the other, that sharpens by a reciprocating rectilinear motion simultaneously both cutting edge facets of a knife. The knife is held by three sets of jaws in a positioning means designed to be free floating in lateral position between the abrasive pairs and to moderate insertion of the blade into the positioning means by engaging the sides of the knife in one or more of three (3) grooved blocks. In addition to its complexity this sharpener has the disadvantages inherent in all rectilinear motion sharpeners which leaves a serrated knife edge which cuts by tearing and has poor wear characteristics. The free floating design of the positioning means and the inherent tendency of the two cutting edge facets of the blade to jam in the grooved block makes this inapplicable in virtually any other sharpener. Because both sides of the knife of sides of its cutting edge facets are used to moderate the degree of knife insertion into the sharpener, and because of the free floating lateral motion, this prior art positioning means is inapplicable where a precise positioning of the knife edge is necessary. The degree of insertion of the knife edge and hence its position depends on the width of the knife, on the width and angle of its cutting edge facet and on the degree of manual pressure applied during insertion and movement of the knife.

U.S. Pat. No. 2,751,721 describes a sharpener with a drum shaped abrasive element where the knife cutting edge facet is sharpened against annular portion of the drum surface that rotates in a plane perpendicular to the axis of rotation of the drum. The abrading force on the cutting edge is determined solely by the degree of hand pressure applied to the knife by the operator which leads to significant inconsistencies in abrading rate, poor edge formation, and gouging of the edge -- problems common to much of the prior art. Position and stability of the knife within the holder and angular control of the cutting edge facet against the abrasive surface is poor because of their dependency on the amount of pressure applied by the operator and by the profile of the several bevel faces common to the existent variety of commonly available knives.

U.S. Pat. No. 2,645,063 describes a sharpener with a drum surface and a guide mechanism which provides stops that position the knife by bearing directly on the cutting edge itself. Such stops are impractical because of the constant dulling effect on the edge created by rubbing it directly across and normal to one surface of the guide. This patent and U.S. Pat. No. 2,751,721 describe sharpeners that incorporate a magnet. The magnetic field does not support or guide the knife.

SUMMARY OF THE INVENTION

Many of the problems associated with the rapid generation of thin, fine edges on dull knives and other blades are overcome with the method and apparatus described here which include precision control of sharpening steps employing an improved disk sharpener. Also claimed is such disk sharpeners in combination with orbital sharpening as described in the copending application cited above. The use of a unique disk sharpener as described here can produce quickly in hands of the inexperienced a well defined and reasonably sharp edge with reduced risk of gouging, overheating, or damaging the general contour and shape of the knife edge. Following the use of a disk sharpener, by using the unique orbital sharpener of the copending U.S. application cited above, a very thin and finer edge can be generated quickly. Most effective use of these methods and apparatus depends critically on the control of sharpening angle in each step.

The disk sharpener described here is equipped with a precision knife guide and a precision non-damaging stop mechanism that acts on just one of the cutting edge facets as part of a knife control system that uniquely positions one knife cutting edge facet in contact with and parallel to that face of an abrasive disk which is perpendicular to its axis of rotation. The guide, preferably magnetic, contiguous to the abrasive disk face simultaneously controls precisely the angle of the knife face relative to that face of the disk, and in conjunction with a biasing means acting on the disk controls the level and consistency of force of the abrasive disk against the knife cutting edge facet, and avoids the serious problem of gouging the knife edge common the prior disk sharpeners. The disk and guide means are positioned precisely with the knife removed to be contiguous, defined here as immediately adjacent but restrained from touching. The separation of the disk face and guide is quite small usually less than 1/16 inch. The guide and stop means are aligned so as to insure that the length of the knife cutting edge facet remains parallel to the plane of the disk face while allowing either the disk or the guide means to move relative to theother against a biasing means. Such biasing means is defined here to include a spring, a solenoid, magnetic effects of a motor armature or other force means that while urging the disk and guide to move closer allows a finite displacement of the disk against the biasing means to insure that biasing force is being applied during sharpening. Biasing action of this sort provided by a spring or other force device in conjunction with the precision stop mechanism insures that the rotating disk will rotate against one edge facet of the knife with a consistent and predetermined force during the sharpening process and thereby establishes precisely the level of abrading force applied. This unique disk sharpener generates rapidly a knife edge on the order of 1/1000 inch or less in thickness, the actual thickness depending significantly on the knife material, abrasive grit size and other factors.

The disk in one configuration is equipped with a central hub that protrudes sufficiently beyond the face of the disk to prevent knives from being scored or scratched if they are improperly handled during use of the disk sharpener. In another configuration an extension of the housing surrounding the disk serves a similar function.

Following the use of a disk sharpener which removes large masses of metal, further sharpening with an orbiting sharpener incorporating an accurate knife guide or holder permits rapid further metal removal for creation of a knife edge on the order of 1/10,000 inch or less in thickness. The ultimate width of the edge is established primarily by the properties and quality of steel or other material used in the knife. The guide, preferably magnetic, used to position the knife in this orbital sharpening step commonly positions the face of the knife relative to the plane of the orbiting abrasive surface at an angle, referred to herein as the second sharpening angle, preferably larger than the first sharpening angle between the face of the knife and the plane of the abrasive disk used in the preceding disk sharpening step, referred to herein as the first sharpening angle. This will cause the orbiting abrasive to sharpen the knife cutting edge facets at a slightly greater total included angle than their existing total angle after the disk sharpener.

The combination of disk and orbital sharpening is unique because of the overall speed with which a very fine edge is formed. The disk sharpener disclosed here can quickly preform the knife edge which is then passed through the orbital sharpener to develop rapidly a razor like edge.

The invention, will be more fully understood from the following description when read together with the accompanying drawings.

DETAILED DESCRIPTION

Figure 1:
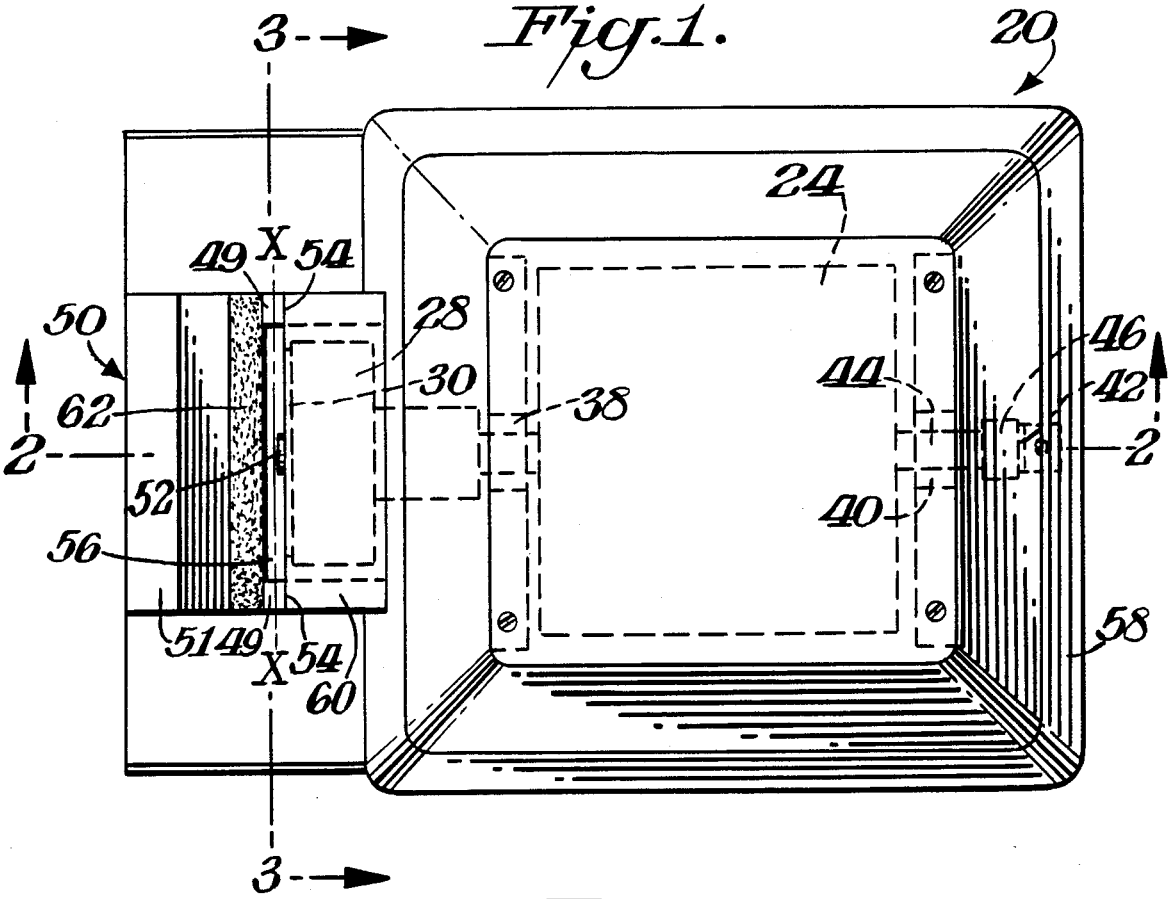
FIG. 1 is a top plan view of an improved disk style sharpener according to this invention.

The method and apparatus of this invention is described first in thier broadest overall aspects with a more detailed description to follow.

This invention is based on a disk type sharpener used so that the knife edge and cutting edge facet is held parallel to that flat face of an abrasive disk perpendicular to its axis of rotation. That face which is perpendicular to the axis of rotation of the disk and contains the predominent number of surface abrasive elements will be referred to herein as the disk's principal plane. A disk used in this manner has an inherently favorable characteristic compared to grinding wheels, bevel-edge disk sharpeners and rectilinear motion sharpeners in that the abrasive disk as disclosed here move abrasive elements simultaneously across portions of the knife edge in a variety of directions such as essentially into the knife edge, away from the edge, and in one direction parallel to the edge. This characteristic has the advantage of minimizing burr formation and removing substantial portions of any burr that is formed compared to a strictly rectilinear motion. The abrasive action of the disk however lacks the true balanced omnidirectional abrading action characteristic of the orbital action used in the combination apparatus described here. A disk so used with a knife positioning system comprised of a guide and two stops for the cutting edge facet of the knife as described herein has further advantage because of the surface planarity of the disk and because of the sizable surface area in contact with the knife edge thereby maximizing the opportunity to retain a straight edge on the knife and minimizing the chances of "grabbing" the knife cutting edge facet and gouging or scalloping the edge.

The disk sharpener claimed in this present invention overcomes, through unique design, the disadvantages of prior art abrasive disk sharpeners. Sharpening is carried out on the disk's face perpendicular to its axis of rotation with inherent advantages of varied abrasive motion relative to the knife edge, surface planarity, and low burr formation as compared to sharpening on the bevel edge of the disk. This is accomplished first by employing with the abrasive disk a contiguous precision knife guide but in the absence of the knife there is a small gap usually less than 1/16 inch between the guide and disk. The guide suitably designed can control reliably the knife at a predetermined position and fixed angle relative to the principal plane of the disk irrespective of the knife thickness or shape and contour of the face of the knife. Because the guide is contiguous to the disk and because its guide face extends along and across the entire disk surface near the sharpening line, it gives unusually good support to the knife and allows precision sharpening of virtually the entire knife edge even with short knives. The knife must be held firmly enough by the guide and in a manner that maintains invariently the relative knife/disk sharpening angle along the entire length of the edge facet being sharpened. Preferably this guide is of the magnetic type disclosed in the copending application cited above but other holders can be used. This guide together with other improvements described here assist in eliminating the tendency of prior art disks to grab and often forceably cause the user to lose physical control of the knife when positioned parallel to the disk face, to lose control of the edge sharpening angle and to gouge, scallop or put undesirable grooves in the knife blade.

As illustrated, the magnetic knife guide has a magnetic guide surface in a plane at an angle to and intersecting the abrasive surface to form a line of intersection therewith. The magnetic guide surface has north and south poles along lines substantially parallel to the line of intersection. One of the poles is along a portion of the guide surface remote from the abrasive surface and the other pole is along a portion of the guide surface contiguous to the abrasive surface. The magnetic guide surface is located contiguous to the abrasive surface with its contiguous edge being spaced by a distance on the order of 1/16 inch or less from the abrasive surface. the resultant magnetic field at the abrasive surface creates a steady force which not only holds the knife at its lower face, but also urges the cutting into contact with the abrasive surface and maintains that contact. In addition the magnetic field removes sharpening debris away from the abrasive surface while the knife is being sharpened.

While the magnetic arrangement described is a preferred embodiment it must be emphasized that nonmagnetic means, such as combinations of levers and springs could be used to provide the unique and highly desirable combination of effects discovered that hold the knife against the guide, urge the cutting edge into contact with the abrasive and maintain that control during sharpening. The superior sharpening performances and improved knife edges that have been demonstrated rely in part on this unique combination of effects that steady the knife and apply a desirable force level on the knife facet as it rests against the diamond abrasive.

Gouging and scalloping with disk sharpeners can occur due to lack of control of the amplitude of applied force between the knife and the rotating disk. The applied force in prior art disk sharpeners is a strong function of the operator's techniques and skill, the knife thickness and geometry, and other design factors. To eliminate this in the present invention, the handle of the knife is positioned by the operator so that the face of the knife rests on the contiguous guide plane established by the face of the guide, which in a preferred case is magnetic, and the knife face is moved downward and toward the disk until the first cutting edge facet contacts the rotating disk, moves the disk some distance against an appropriately selected biasing force, and then comes to rest firmly against two precisely located stops appropriately located contiguous to, defined here as immediately adjacent to but not touching, the circumference of the disk that limit further movement of the knife toward the disk and forceable align that cutting edge facet parallel to the principal plane of the rotating disk. The principal plane of the disk face during displacement remains parallel to its plane in the rest position. The extent of displacement of the disk is determined by the position of the disk face in its rest position and by the location of the stops that act only against the first cutting edge facet, that facet which is also in contact with the face of the disk. The use of such stops across which the cutting edge facet of the knife is moved precisely locates that facet during sharpening and in no way damages the cutting edge itself. With the guide contiguous to the disk surface and with stops that act only on the one cutting edge facet, the sharpening angle is maintained precisely without any error introduced by knife thickness or curvature of the bevel face of the knife.

The rotating disk mounted on the armature shaft of a suitable motor is biased to urge it toward the guide by a means such as a spring, or the force of motor magnetic effects acting on the armature, but means are provided to limit the disk motion so that in rest position with the knife removed the disk face is immediately adjacent to but not touching the knife guide. The force constant of the spring or other biasing means acting on the disk directly or indirectly uniquely determines the force applied by the disk face on the knife cutting edge facet as the knife moves the disk laterally and the cutting edge facet comes to rest on the provided stops. In this manner the disk remains at all times "spring loaded" against the cutting edge facet during sharpening. When the disk is attached rigidly to the motor armature shaft, the motor can be designed to permit enough uninterrupted lateral motion (end play) of the armature and its shaft to accommodate the lateral displacement of the disk between its rest position and its displaced position as established by the position of the cutting edge facet when against the stops. It is convenient to use a leaf spring against the end of the armature shaft opposite the disk to apply the desired biasing force to the disk. The spring can, of course, be located alternatively so as to press directly on the back face of the disk or on some other point along the shaft that supports the disk. The spring force can be essentially uniform with spring displacement or it could be constructed to be non-uniform.

There are many physical configurations that will provide the same biasing action. For example, the motor can be supported so it can be moved by springs biased in direction of the disk. Similarly the disk can be mounted on a separate shaft and driven by means of gears or belts, etc., from the motor shaft where a spring system could act directly on the rear of the disk or on its separate shaft. The stop arrangement disclosed here which acts on the cutting edge facet minimizes the extent of free travel of the disk needed to accommodate the wide variety in size and styles of household knives.

Equivalent ability to control the force of the knife's cutting edge facet during sharpening can be realized by allowing the knife holder to move away precisely from a stationary disk to accommodate knives of different thicknesses. The disk is stationary in this latter example in that it is not free to move laterally in a direction along its axis of rotation. In that case a spring or other biasing means would act on the holder in a manner to press it in the direction toward the stationary disk. However in rest position with knife removed the holder would be contiguous to but not allowed to touch the disk.

Regardless of the means used to control the abrading force during sharpening it is important that the design be such that the required movement of the disk or holder can be realized without any change to the sharpening angle, defined here as that angle formed by the plane of the guide on which the face of the knife rests relative to the principal plane of the abrasive disk, irrespective of blade thickness, width, or length. Neither the disk face or the holder should be allowed to tilt as their relative separation distance changes. For example, where the disk is the moving element, the principal plane of the abrasive disk should, during lateral motion of the disk, remain parallel to the principal plane of the disk in its rest position.

In order to avoid accidental damage to the sides of the knife in certain disk type sharpeners, in the event the sharpener is used carelessly, a part of this invention is a central hub, usually of plastic, on the disk that protrudes just sufficiently from the principal plane of the disk to stop the face of the knife at some point above the cutting edge facet of the knife before it can accidentally contact the abrasive on the disk. The hub must be designed so that it offers this protection without interfering significantly with ability to place and hold the blade edge against the annular portion of the disk. The hub is applicable in disk sharpeners where the edge of the knife contacts the disk substantially below the center of the disk and where the face of the knife passes during sharpening in front of the axis of rotation of the disk.

Other protective means are described that are useful irrespective of knife location on the disk.

As further protection against damage to the knife edge from overheating during sharpening, it is desirable to use a motor with adequate power for sharpening but not of such higher power as to cause serious damage to the edge if the knife accidentally jams and stalls the disk. The disk diameter determines in part the force delivered to the knife, and the velocity and mass of the rotating system also influences the force and kinetic energies involved at knife edge if the disk stalls. A disk diameter of 1 to 3 inches and a motor with running torque on the order of 9 inch-ounces works well and minimizes the danger of damaging the knife. A disk diameter of this order provides adequate flat area to spread the sharpening energy over a sufficient knife length to give uniform sharpening action along the cutting edge facet. Disks of other diameters can be used with appropriately selected motors. A friction clutch can be used as another means to control the forces, torques, and energy deliverable to the disk.

Figure 2:
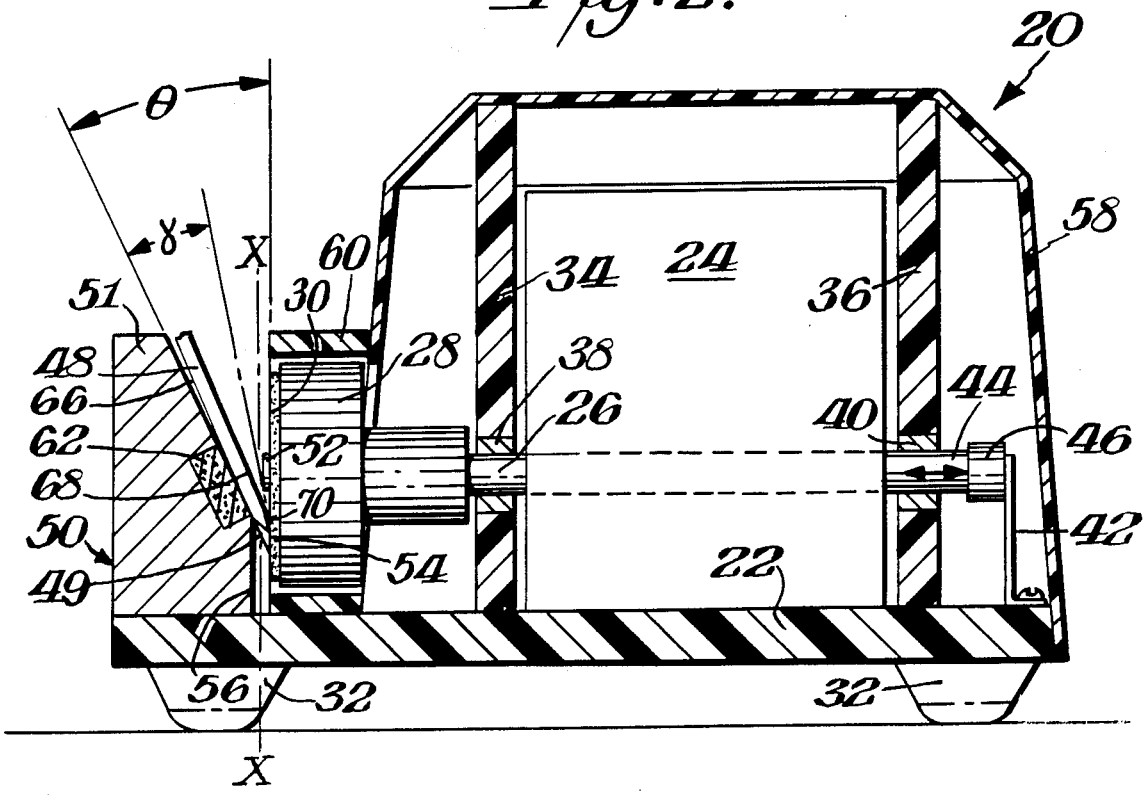
FIG. 2 is a cross sectional side elevational view taken along line 2—2 of FIG. 1.
Figure 3:
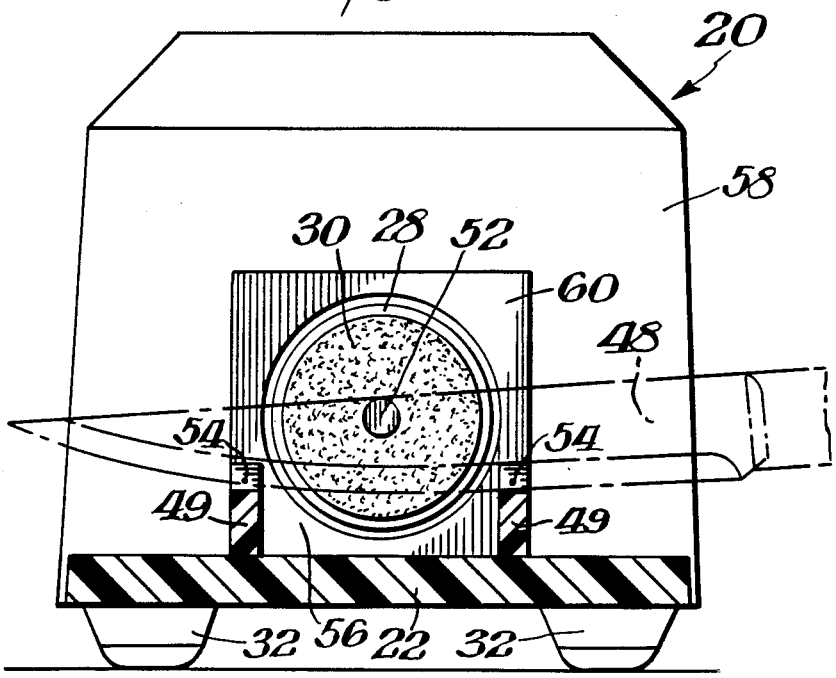
FIG. 3 is a cross sectional view in elevation taken along line 3—3 of FIG. 1.

FIGS. 1 through 3 illustrate, by way of example, a preferred configuration of an abrasive disk sharpener 20 incorporating the improvements discussed here. On a base plate 22 is mounted a motor 24 whose left shaft 26 drives disk holder 28 on whose face is mounted an abrasive surfaced disk 30. The disk holder 28 and the abrasive disk are surrounded by plastic enclosure 60 open to expose the abrasive disk to the knife and fastened by screws, not shown, to base plate 22. The base plate 22 is supported on rubber feet 32. The motor shaft 26 and the right armature shaft extension 44 pass through vertical structural support members 34 and 36 attached by screws (not shown) or other means to base 22 and ride in sleeve bearings 38 and 40. A biasing means in the form of a leaf spring 42 supported on the base plate 22 acts against rear armature shaft extension 44 to apply spring force and pressure to rear armature shaft extension 44, free to move some distance laterally, through thrust bearing 46 or other means. The knife 48 in FIGS. 2 and 3 rests against the knife guide 50 with its cutting edge facet parallel to and against the face of disk 30 rotating in a plane perpendicular to its axis of rotation. Hub 52 on the disk protrudes slightly from the face of disk 30 and prevents accidental contact between a side or upper face of the blade and the abrasive surface of the disk.

Stops 54, integrally part of the vertical faces of plastic enclosure 60 opposite the knife guide 50, as shown in FIGS. 1 through 3, establish in a positive manner the limit of motion of vertical cutting edge facet of the knife in the direction of the abrasive disk 30 and establish positively the position of the cutting edge facet on the disk 30 during sharpening. The stops 54 act only on the vertical cutting edge facet. Those portions of the vertical faces of enclosure 60 that act as the stops 54, are positioned so that when the vertical cutting edge facet is against the enclosure 60 at those points designated as stops 54, the line of that facet is parallel to the principal plane of the abrasive disk. The stopping action can be obtained by designing and locating stops 54 independent of the enclosure 60 but in any event, the stops 54 should be contiguous to but not touching the circumference of the disk holder 28. The stops 54 if made of material independent of enclosure 60 can be made of any of a wide variety of materials such as a high lubricity plastic, a metal such as martensitic steel, a metal roller, or even of a mild abrasive material similarly located that will remove burrs or mildly abrade the facet surface as it is moved over the surface of the stop.

A plastic housing 58 encloses the motor 24 and the supporting members 34, 36, etc. The plastic enclosure 60 used to enclose most of the rotating disk holder 28 serves also to minimize any safety hazard from the rotating disk 30.

FIG. 2 includes in cross section the illustrative knife guide 50 that contains in plastic structure 51 a rigid magnetic element 62 that attracts the knife and establishes a guide plane for the face of the knife. The angle of the face of the knife 48 resting on the guide plane is established relative to the plane of the disk by the rigid magnetic element 62 located at a position primarily adjacent to the knife's lower bevel face 68 as defined graphically in FIG. 4. The guide opposite disk 30 is contiguous to but not in actual contact with the face of the abrasive disk 30, separated therefrom by a small gap 56. As part of guide 50, the lower guide extensions 49 whose upper faces are set as extensions of the guide plane established by the magnetic element 62 to guide the knife face, are in intimate contact with the face of enclosure 60 on each side of disk holder 28. The illustrative knife 48 in FIG. 4, has an upper bevel face 66 and a lower bevel face 68. The cutting edge facets 70 of the illustrative knife, FIG. 4, converge to form the cutting edge. Movement of the abrasive on the face of rotating disk 30 creates forces on the knife 48 in contact with disk 30 that tend to cause the lower knife bevel face 68 to rest naturally on the rigid magnetic element 62. It has been shown to be more difficult, less stable, and less precise to control the sharpening angle by resting the knife's upper bevel face 66 against the holder face. With knives that might have only a single bevel face such as 66 of FIG. 4 for example and no lower bevel face 68, the single face would extend to the edge facets 70 and such knives are of course very stable in the guide.

The disk 30, FIGS. 1 through 3, rotates preferably at a speed that generates linear circumferential speed of the abrasive particles not greater than 800 feet per minute, the speed above which burning of the knife edge can occur readily. The disk type sharpener can be used with any of a variety of rigid knife guides; however, in order to obtain accurate, reliable and precise control of the sharpening angle an improved guide such as shown is preferred.

The hub 52 FIGS. 1 through 3 that extends from the abrasive surface by a carefully chosen distance, t, (as defined in FIG. 5) can be attached to the disk surface as shown or press fitted as a short rod into a center hole in the disk 30 and disk holder 28 of FIGS. 1 through 3. This hub 52 must not be so thick that it causes the knife 48, FIG. 2, to jam between the hub 52 and the face of guide 50 or prevents the cutting edge facet 70 of knife 48 from extending sufficiently toward the gap 56 and against the surface of the abrasive disk 30. However, the thickness, t, of hub 52, FIG. 1, must be at least a few thousandths of an inch or commonly about 10 1 to 20 thousandths of an inch thick with a 1–2 inch diameter disk--enough thickness to prevent the lower knife bevel 68 from accidentally being jammed against the face of rotating disk 30. Commonly the hub thickness will be less than a few percent of the disk diameter.

The hub 52 of FIGS. 1 through 3 by virtue of its thickness of 10 to 20 thousands of an inch restricts insertion of knife 48 to that space within the clearance angle $\gamma$, FIG. 2 which by this example would be on the order of 3° less than the sharpening angle $\theta$, commonly about 20°, FIG. 2. Sharpening angle $\theta$ is that angle defined by the knife-guiding face of knife guide 50 in FIG. 2 and the face of abrasive disk 30. Clearance angle $\gamma$ is defined by the knife guiding face of knife guide 50 and a line from the cutting edge facet to the left most edge of hub 52. The disk 30 can be of any diameter and rotated at any RPM preferably chosen in combination so that the maximum linear speed of abrasive particles on the disk 30 is less than 800 feet per minute. It is necessary that the knife cutting edge facet 70 of FIG. 4 be in contact with the disk sufficiently far from the disk center that it does not encounter the hub. Typically the disk might have a diameter between ½ to 3 inches and the hub a diameter of 1/16 to ¼ inch, a diameter of around 10 percent of the diameter of the abrasive disk itself. While the hub can be made of any material, ideally it is of a plastic or similar composition that will not scratch or mar the surface of the knife during sharpening if the knife blade should come in contact with it.

The position of the cutting edge of knife 48 relative to where it crosses the face of abrasive disk 30, as shown in FIG. 3, is controlled by the height of that point where the guide plane for the face of the knife intersects the plane of the stops for the vertical cutting edge facet. The cutting edge will normally be slightly above that point. The abrasive particles of disk 30 move multidirectionally across the cutting edge facet of the knife. That is, they move across some portion of the knife edge facet in a direction more or less into the edge (upward in FIG. 3), while other portions of the knife experience abrasive elements either moving predominantly away from the edge (downward in FIG. 3), and in the central area of contact with the knife particles of the abrasive disk more essentially parallel to the knife edge.

Because the various means described in this invention permit for the first time precise controlled sharpening of a knife without gouging on the flat surface of the disk perpendicular to its axis of rotation it is possible to realize the advantages of this multidirectional abrasive action just described that results in minimum burr formation on the knife edge. For this reason, this disk sharpener is uniquely suited to presharpen the knife before subsequent orbital sharpening steps that through true omnidirectional abrasive action places a finer edge on the knife on the order of 1/10,000 inch edge width.

Referring to FIGS. 1 and 2 and recalling that the disk 30 is biased by a restraining force such as a leaf spring 42 pressing in the direction of the holder, it is clear that as the knife 48 held in guide 50 is pressed down the plane of the guide face until the knife's cutting edge facet meets stops 54 on the face of enclosure 60 the face of disk 30 is forced by the cutting edge facet 70 to move laterally from its rest plane X—X against the biasing means to the right. The force that the disk 30 exerts against cutting edge facet 70 is determined solely by the force of the leaf spring 42. The free travel of the disk 30 and the spring 42 must be large enough to avoid forcing the disk 30 and supporting shaft 26 to reach the travel limits before the knife cutting edge facet rests on the stops 54.

Figure 13:
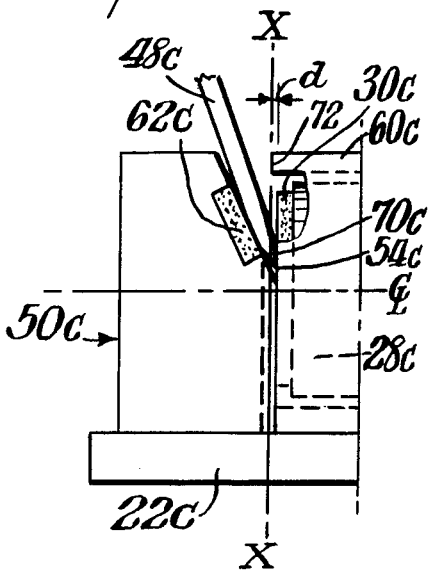
FIG. 13 is an elevation of a knife guide with a protrusion to prevent accidental abrasion of knife face.

It is important to emphasize that mechanical modifications can be made so that the knife guide **50*c* will position the knife cutting edge facet 70*c* against the face of disk 30*c* on a line above the disk center as shown in FIG. 13. In that event a hub such as 52*a* of FIG. 5 will not be necessary. The knife guide 50*c* of FIG. 13 has a magnetic element 62*c* located in the surface of the guide 50*c* at a point above the center of the abrasive disk 30*c* so as to position the knife's vertical cutting edge facet 70*c* above the center line of disk 30*c*. Movement of knife 48*c* down the face of guide 50*c* causes the knife's vertical cutting edge facet 70*c* to contact the face of abrasive disk 30*c* in its rest plane X—X FIG. 13 and to move the disk to the right against biasing means, not shown, that insures full restraining force of spring or other means on the knife vertical cutting edge facet but avoids pushing the disk 30*c* beyond its limit of free lateral travel to avoid excessive pressures on the knife cutting edge facet and possible gouging of the edge as described herein. By causing the knife's vertical cutting edge facet 70*c* in FIG. 13 to rest on the stops 54*c* shown as integral parts of the vertical faces of disk enclosure 60*c*, that is one on each side of the disk, it is possible to position the cutting edge facet parallel horizontally to the face of the disk 30*c* without any physical contact with the cutting edge itself. The face of stops 54*c* of enclosure 60*c* of FIG. 13 can be made to be parallel vertically to surface of the disk 30*c* and hence parallel to the vertical cutting edge facet during sharpening; alternatively the face of stops 54*c* of enclosure 60*c* on each side of the disk 30*c* can be sloped vertically slightly (a few degrees) toward the knife guide 50*c* so that the heel of the knife's vertical cutting edge facet 70*c* contacts and slides along the face of stops 54*c*; or the faces of stops 54*c* can be sloped vertically slightly away from the knife guide to be more effective in removing burrs and/or abrading slightly the cutting edge facet particularly adjacent to the cutting edge. Stops that function in an equivalent manner need not necessarily be a part of enclosure 60*c* but could be of separate construction and attachment to base 22*c*** as described herein.

Irrespective of whether the sharpening is carried out above the center of the disk, as shown in FIG. 13, or otherwise on the disk, it is possible to provide protection for the face of the knife by a protective projection 72 that can be attached to enclosure **60*c* located about ¼ to ½ inch above the normal location of vertical cutting edge facet during sharpening and protruding toward the knife guide 50*c* a distance d, on the order of one to sixty (60) thousandths of an inch beyond the principal plane of the abrasive and beyond that line across the face of enclosure 60*c* where the knife's vertical cutting edge facet is stopped during sharpening. This projection 72 can be physically part of the enclosure 60*c*, FIG. 13**, or a separate physical structure without deviating from the sense of its function here.

Biasing action such as created by a spring that applies force on the knife edge during sharpening can be realized either by applying that force to the disk drive and support system as described above where the disk is free to move laterally, and the guide is stationary, or a similar result can be obtained by applying the biasing action and restraining force to the knife guide while maintaining the disk in a stationary position.

Figure 5:
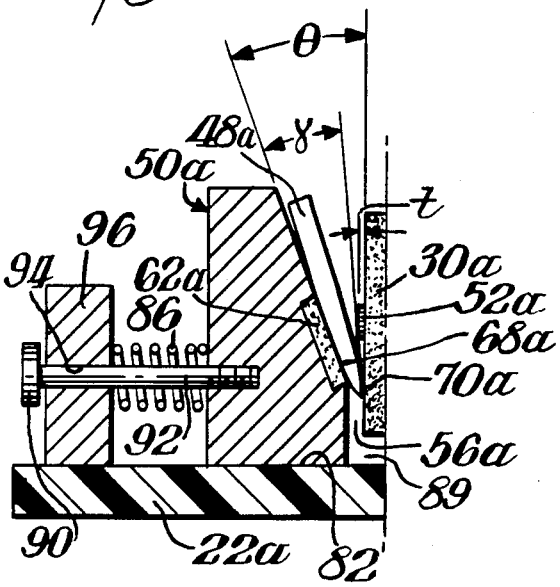
FIG. 5 is a cross sectional view of an alternate disk and knife guide constructed according to this invention.

FIG. 5 shows a knife guide **50*a* and a stationary disk 30*a*where the guide 50*a* is free to slide laterally along the surface 82 of base plate 22*a* while being pressed to the right by a compression spring 86 located behind the knife guide 50*a*. In use the face of knife 48*a* resting on the guide surface as shown in FIG. 5, is moved down the plane of the guide surface toward the abrasive surface until the vertical cutting edge facet contacts the surface of abrasive disk 30*a*. Any further force than displaces the guide 50*a* to the left in FIG. 5, against the biasing action of compression spring 86 until the lower cutting edge facet contacts stops 89 which are extensions of the guide on each side of the disk. The slope of the upper face of stops 89 is selected normally to be essentially parallel to the lower cutting edge facet. Hence, the upper face of stops 89 is at an angle to the principal plane of the abrasive substantially greater than the angle that the plane of the magnetic element 62***a* makes with the principal plane. When the lower cutting edge facet comes to rest on the face of stops 89 the knife position is stabilized and the full force of spring 86 is acting to hold the vertical cutting edge facet against the abrasive disk 30*a*. The user can sense when the lower cutting edge facet is against stop 56*a* since a much greater force must be applied to the knife in order to obtain further displacement of the knife holder 50*a* beyond that point. The slope of the upper face of stops 89 can alternately be set at an angle essentially perpendicular to the knife edge to provide a more definitive stopping action. Disk 30*a* of FIG. 5 is stationary in that it is not free to move laterally in a direction parallel to its axis of rotation. When the knife 48*a* is removed, the guide 50*a* moves to the right a distance determined by the guide stop 90 which establishes the rest position of guide 50*a* and insures that the knife guide 50*a* will not move against the surface of the stationary rotating disk 30*a* but remains contiguous to it separated from it by a finite gap 56*a*. Alignment of the knife guide 50*a* relative to disk 30*a* is maintained by shaft 92 that moves through bearing hole 94 in support member 96 fastened to base plate 22*a*. More than one spring and shaft can be utilized to increase the accuracy of alignment and freer motion of the guide. Stops 89 that act on the lower cutting edge facet FIG. 5 should be positioned so that parallel alignment of the vertical knife cutting edge facet 70*a* relative to the principal plane of the abrasive disk is maintained during sharpening. A hub 52*a* is shown that functions the same as hub 52 of sharpener 20 of FIGS. 1, 2 and 3. Angle $\theta$ is the sharpening angle that is the angle between the face of knife guide 50*a* and the principal plane of the abrasive disk 30*a*. Angle $\gamma$ of FIG. 5 is the angle between the face of the knife guide 50a and a line extended from the upper terminous of the cutting edge facet 70 to the face of hub 52*a*.

The improved disk sharpener of preferred embodiment shown in FIGS. 1 through 3 disclosed here has been shown to produce very quickly a good edge on a wide variety of knives without scoring, gouging, or otherwise damaging the knife. It has been found also that it produces a minimum burr compared to unidirectional abrasive actions of grinding wheels, beveled disks, hard stones, and the like. This rapid action, the good quality edge, convenience of use, and reduced burr make this an ideal sharpener to be used in combination with the orbital sharpener described in the copending patent application cited above. The orbital sharpener while a relatively fast sharpener removes metal at a slower rate than the disk sharpener for a given grit size. The disk commonly has a relatively coarse abrasive in the range of 100–180 grit. The orbital sharpener can rapidly generate a superior fine, thin edge of less than of 1/10,000 inch wide after first presharpening the knife in the disk sharpener. The absence of a sizeable burr allows final edge formation to occur rapidly with an orbital sharpener. There are many other sharpeners known in the art that can be used to place an edge on the blade prior to the use of the orbital sharpener, however, the improved disk sharpener is a particularly unique choice because of reasons discussed herein.

In particular for sharpening knives that are dull or have a poorly formed edge the unique combination of an improved disk sharpener as disclosed here with an orbital sharpener as disclosed in the copending patent application cited above will form rapidly less than 1/10,000 inch wide edge on a blade. The apparatus as shown in FIGS. 11 and 12 combines these two unique processes into a single sharpener that can be used by the inexperienced to produce reliably and rapidly razor-sharp edges.

Figure 11:
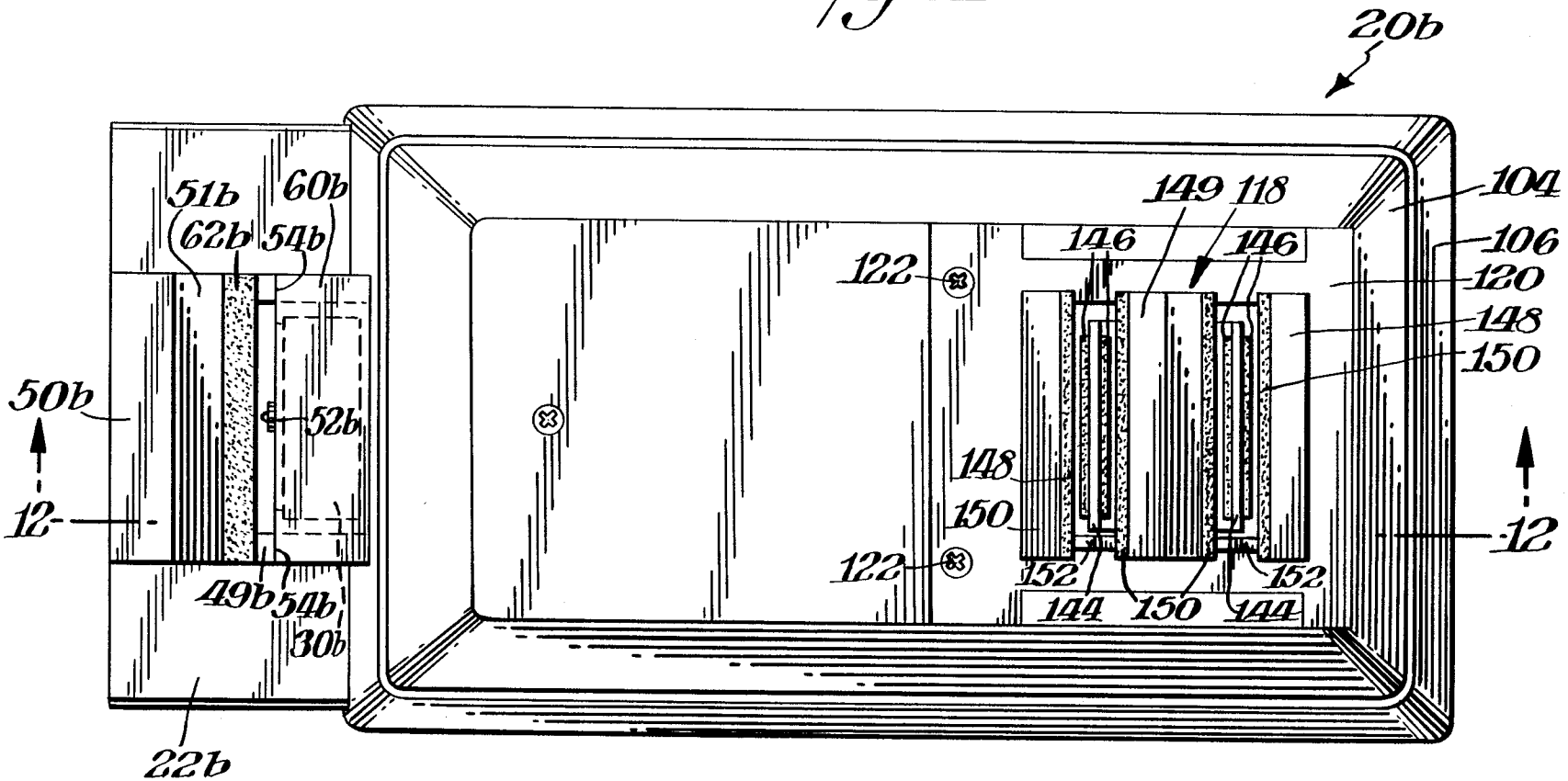
FIG. 11 is a plan view of a combined disk sharpener and a two stage orbiting sharpener in a single apparatus constructed according to this invention.
Figure 12:
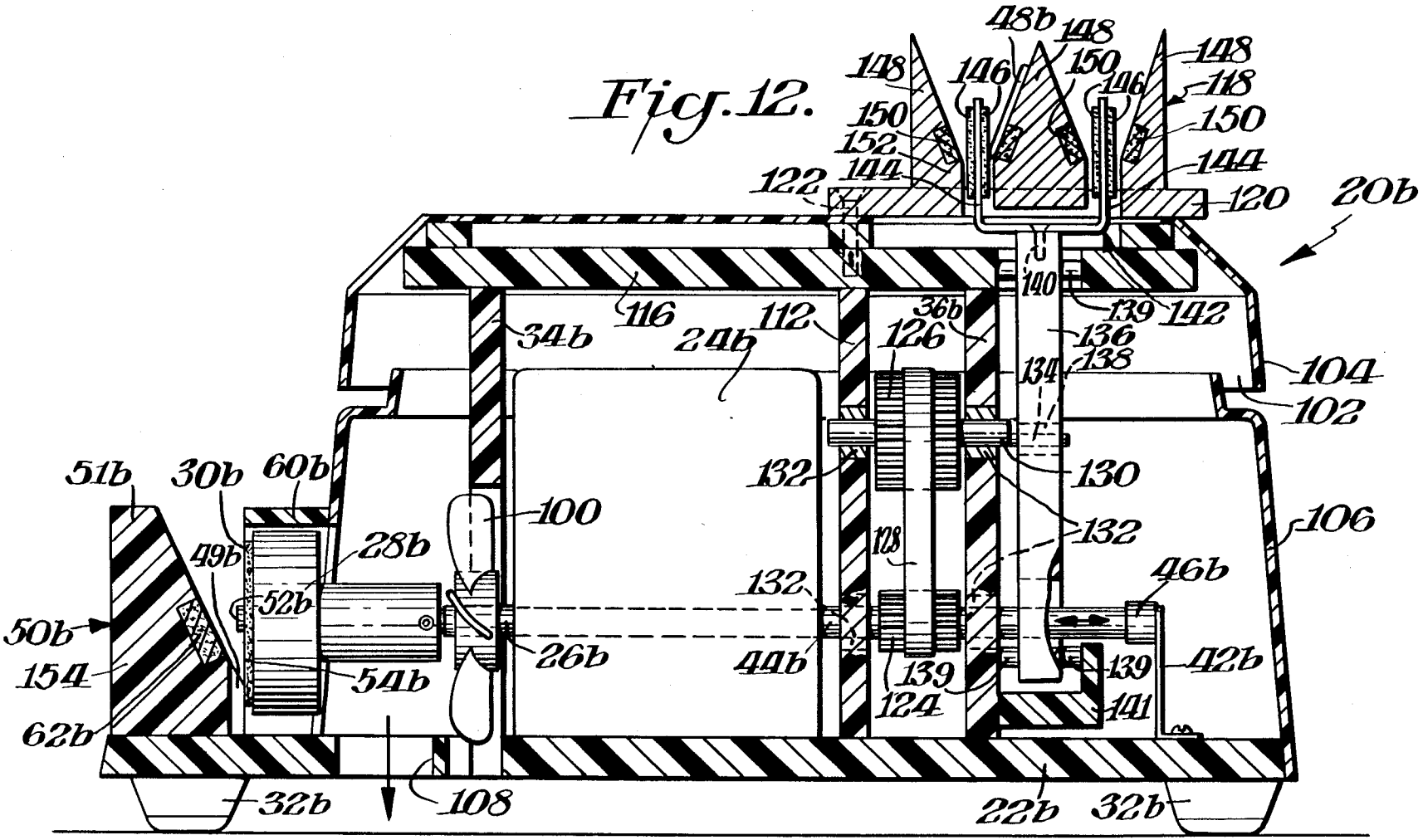
FIG. 12 is a cross sectional elevation view taken along line 12—12 of FIG. 11 of a combined disk sharpener and a two stage orbiting sharpener in a single apparatus constructed according to this invention.

The improved disk sharpener in combination with an orbital sharpener is shown, by way of example, in FIGS. 11 and 12. Base plate 22*b*, FIG. 12, supports motor 24*b*, fastened to base plate 22*b* by screws or other means (not shown), whose left shaft 26*b* drives disk holder 28*b* on which is mounted abrasive disk 30*b* that rotates about 3000 RPM but at a maximum surface abrasive circumferential velocity of less than about 800 ft./minute to reduce the risk of overheating the knife edge. Fan 100 mounted on shaft 26*b* serves to cool motor 24*b*. Air enters the apparatus through the annulus 102 between upper cover 104 and lower cover 106 and exhausts out a base opening 108 in the base plate 22*b* which is supported on rubber feet 32*b*.

Vertical support members 34*b*, 112, and 36*b*, FIG. 12, secured to base 22*b* by structural adhesive or screws (not shown) support upper horizontal support member 116 which in turn supports the knife guide assembly 118 through the knife guide base 120 that is fastened securely to upper horizontal support member 116 by one or more screws 122 as shown. Drive gear pulley 124 mounted on right armature shaft extension 44*b*, FIG. 12, drives two gear pulleys 126 (one shown) synchronously by means of timing belt 128 (toothed). The armature shaft extension 44*b* and shafts 130 for attached gear pulleys 126, ride in sleeve bearings 132 inserted into vertical support members 112 and 36*b*. A more detailed description of the orbiting drive system is included in the copending patent application cited above. Two synchronously driven cranks 134 machined onto the end of shafts 130 ride within the glass filled fluorocarbon sleeve bearings 138 inserted in drive plate 136 and generate an orbital motion of drive plate 136. There are shown in FIG. 12 two sets of the three (3) or more support bearings 139 held by bracket 141, horizontal support member 116, and support 36*b* bear slidingly on drive plate 136 to hold drive plate 136 in a vertical plane with minimum motion transverse to that plane as described in the copending U.S. patent application. Attached to drive plate 136 by means of screw 140 is an orbiting yoke assembly 142 which has upper arms 144 on which is mounted orbiting abrasive material 146. Through this structure the orbital motion generated in drive plate 136 creates orbital motion of abrasive material 146.

The knife guide assembly 118, FIGS. 11 and 12, contains plastic structures 148 that support magnetic elements 150 which attract and establish a guide plane for the face of the knife. The knife guide assembly 118 also includes knife stops 152, shown in FIG. 11, that serve a variety of functions as described in the copending application cited above. The knife guide 50*b* used with the abrasive disk 30*b* contains plastic supporting structure 154 that extends and contacts the face of enclosure 60*b*. It contains a magnetic element 62*b* to control the angle of the face of knife relative to the abrasive disk 30*b*. The magnetic element 62*b* which attracts the knife and establishes a guide plane for the face of the knife is essentially as described with FIG. 2. In use the cutting edge facet of the knife placed on guide 50b rests on the stop 54b on the face of enclosure 60b. The drive cranks 134 can be an integral part on shaft 130 as described above or be a separate part affixed thereto. The motor 24b, FIG. 12, must be selected such that its armature and shaft 26b, which on the right of the motor is shown as armature shaft extension 44b, has sufficient end-play to allow the necessary movement or displacement of disk 30b in direction along its axis of rotation to accommodate without reaching a travel-limit the thickest knife to be sharpened. Free end-play on the order of 1/16 inch has proven adequate with most knives to allow the disk 30b to be displaced to the right in FIG. 12 without reaching the limit of travel permitted by the free end-play.

In this manner, when a knife is inserted between the guide 50b, FIG. 12, and the rotating abrasive disk 30b so that the knife cutting edge facet rests on stops 54b, the disk 30b is displaced to the right and it is floating against the biasing force of spring 42b that applies that force to shaft extension 44b through thrust bearing 46b which force is transmitted through the motor armature to shaft 26b and to the disk 30b. Without adequate free end-play in the motor armature displacement of the disk 30b could force the motor armature against its internal stop, not shown, which is usually a thrust bearing, and the disk displacement would then be stopped, thereby generating excessively high forces on the knife by the rotating abrasive disk 30b causing gouging or other physical damage to the knife edge. The spring loading concept employed here in conjunction with the stops 54b on the face of enclosure 60b and the blade guide system provides relatively constant force on the blade edge while being sharpened and uniform sharpening action along the length of knife edge without gouging. The enclosure 60b for the disk shown on lower left is designed to provide a safety cover and structure for stops 54b but without interfering with free knife edge insertion between disk 30b and guide 50b and free contact of the cutting edge facet against the surface of disk 30b.

By combining these two unique sharpeners into a single apparatus it is possible to incorporate knife guides that optimize the sequential sharpening angles $\theta$ in a manner that provides the unskilled with a highly sophisticated contour on the cutting edge facets and a knife of superior cutting performance. Angle $\theta$ is determined by the plane of the guide face on which the blade rests and the plane of the moving abrasive surface, described in the copending U.S. patent application cited above, and shown in FIGS. 2 and 5. It was found that by using a carefully controlled and slightly larger sharpening angle in successive sharpening steps it is possible to decrease markedly the total sharpening time and insure a superior cutting edge on the blade. Although not essential it is preferable that the construction of the knife guides for the disk and subsequent orbiting abrasive sharpening steps by very similar so as to position and hold the knife in an essentially uniform manner in each sharpening position except for deliberate changes in the sharpening angle..

Figure 4:
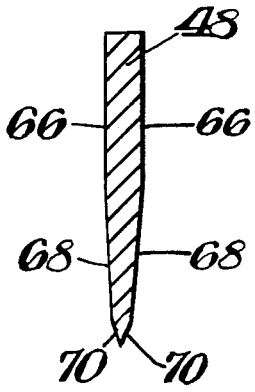
FIG. 4 is a cross sectional view of a typical double bevel faced knife.

Many factory produced kitchen knifes have, by way of example, a total cutting angle as formed by the intersection of cutting edge facets 70 of FIG. 4, greater than 40°. Only rarely does the owner know the actual total angle of cutting edge facets, so any practical means for sharpening must be capable of rapid and foolproof sharpening independent of and without knowledge of the initial edge angle. If it is desired to produce a razor edge, a fine grit abrasive is desirable for finishing the knife, but fine abrasives remove metal slowly. If one did know the initial total angle of the edge facets of the knife and could control the sharpening angle, it would be feasible and practical to use fine abrasive and to sharpen the knife at an angle 1–2 degrees greater than the initial angle so that only little metal need by removed and only in the immediate vicinity of the edge. However, repeated resharpening would have to be done at ever increasing angles if one is to avoid need to remove large quantities of metal, and such resharpenings would ultimately result in a blunt, dull knife. The present invention addresses this problem for the first time in a manner that insures rapid sharpening of a blade to a razor sharp edge without prior knowledge of the initial angle of the cutting edge. To accomplish this, the blade is given an initial sharpening with a coarse grit disk sharpener but at a precisely determined edge angle that is less than the sharpening angles used in the orbital sharpener that uses generally a finer grit size, a lower velocity of the abrasive elements, and the unique orbital motion that produces a razor-like edge.

Figure 6:
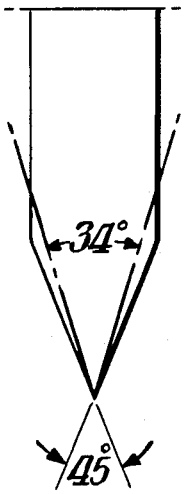
FIG. 6 is a cross sectional view of a knife with a 45° total angle at edge indicating sharpening to be made at 34° by the disk sharpener.

To illustrate the advantages of this invention in an actual sharpening case and referring to FIG. 6 and assuming, by way of example, the knife to be sharpened has its cutting edge facets meeting at an initial total angle of 45°, a popular angle for kitchen knives, it is desirable first that the disk sharpener sharpen the knife to create a precisely known total angle at the knife edge as established by the two cutting edge facets 70 of FIG. 4. This angle should be less than the angle to be created on the facet in subsequent orbiting sharpening stages. A convenient angle of choice might be 34° by way of this example as shown in FIG. 6. This sharpening step entails removal of a substantial amount of metal from the edge, a task the disk sharpener with say 100–180 grit is ideally suited to do rapidly with creation of only little burr on the edge. If by chance the initial total blade angle were less than 34°, the disk sharpener would nevertheless generate a 34° angle on the blade. The resulting blade edge shown in FIG. 7 with a 34° total included angle then can be sharpened to a razor edge in either a one step or multiple step orbital sharpener. The use of two orbital sharpener steps following disk sharpening makes it possible to use first a faster-working coarser grit followed by a finer grit to leave a smoother edge.

Figure 7:
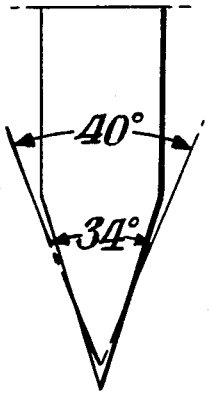
FIG. 7 is a cross sectional view of resultant knife with a 34° total angle at edge formed by first stage disk sharpener indicating sharpening to 40° in the next orbital sharpening step according to this invention.
Figure 8:
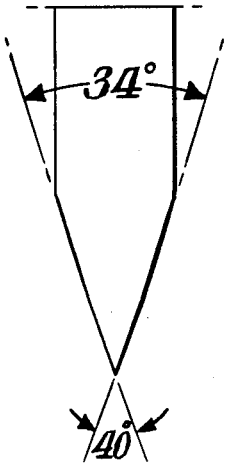
FIG. 8 is a cross sectioal view of a resultant knife showing the 34° and 40° angles formed along cutting edge facets formed respectively by the disk sharpening step and the first orbital sharpening step, according to this invention.
Figure 9:
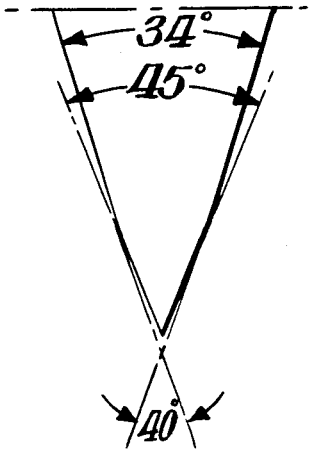
FIG. 9 is a cross sectioal view of the knife cutting edge facet (high enlargement) showing the resulting 34° and 40° angles formed along the cutting edge facets and indicating a 45° total angle to be placed on the cutting edge facets by second orbiting sharpening step.

Illustrating with a two step orbital sharpener, first the knife of FIG. 7 with a 34° total angle is sharpened to a 40° total angle which can be done rapidly with an orbiting abrasive of about 180 grit. This step need entail removal of only a small amount of metal near the edge of the cutting edge facets as seen in FIG. 7, compared to the amount of metal removed in the preceding disk sharpener operation. The resulting blade FIG. 8 has a 34° total angle along the rear of the cutting edge facet and a 40° total angle nearer to the cutting edge itself. In the final orbital sharpening step we can for example use a finer abrasive of say about 600–1500 grit, to recreate the original 45° angle adjacent to the very cutting edge as seen in FIG. 9 (enlarged) by removal of only very little additional metal. Because this series of sharpening steps is incorporated in a single apparatus, it is possible for the manufacturer to incorporate precision knife guides that sharpen in each successive step with a slightly greater angle so that only the disk sharpener has the burden of removing substantial quantities of metal.

The orbiting sharpener has to remove only relatively smaller amounts of metal while placing a fine edge on the knife. Each sharpening step is employed to do what it can do best and the overall result for the inexperienced is rapid formation of a knife with a fine, razor-like edge. The resulting knife edge of this example shown in FIG. 10 and highly enlarged compared to the scale of starting blade of FIG. 6 has three micro bevels along each cutting edge facet 70 that form total angles of 34°, 40°, and 45° respective as one views the knife cutting edge facets at positions progressively closer to the cutting edge. Because that length along the cutting edge facet that is beveled at 45° is very small, usually less than 0.030 inches, it can be sharpened rapidly with the fine grit orbital sharpener leaving essentially no burr on the edge. Any final microburr on the blade edge can be readily removed by pushing the knife edge over and in sliding contact with the knife stops 152 of FIG. 11 before the blade edge facet is abraded by the orbiting abrasive 146. For resharpening a knife once sharpened as described the orbital positions designed to create the 40° and 45° total angles will usually regenerate quickly a fine superior edge without recourse to the disk sharpening stage, and only after a series of resharpenings or hard use would it be necessary to use the lower angle disk sharpener again.

Figure 10:
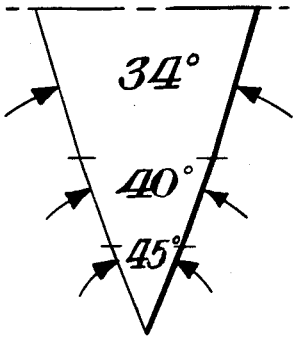
FIG. 10 is a cross sectional view of finished knife cutting edge facets with 34°, 40° and 45° angles formed on the facets as created by the disk sharpener followed by two orbiting sharpening steps according to this invention.

A knife sharpened as just described has a significantly superior cutting quality compared to knives sharpened by more conventional means. A knife sharpened according to this example will have three distinct micro bevels on the cutting edge facet as shown in FIG. 10. Superior cutting qualities of a cutting edge facet with multiple micro bevels are attributable to the fact that the decreasing bevel angles toward the rear of the cutting edge facet offers angular relief immediately behind the edge that allows the material being cut to tend to move away from or to bear less firmly on the rear portion of the cutting edge facet. A knife with appropriate micro cutting edge facets as created by this invention can remove readily a very fine shaving of material from the surface of material as contrast to a greater tendency of a knife to split the surface and dig below the surface if the cutting edge facets are planar as a result of being sharpened only at a single angle.

One can see from the foregoing the uniqueness of combining the new improved disk sharpener with the orbiting sharpener in a single apparatus. Even a very dull knife can be sharpened rapidly by the inexperienced and the resulting knife edge is razor sharp and less than 1/10,000 inch wide.

Figure 14:
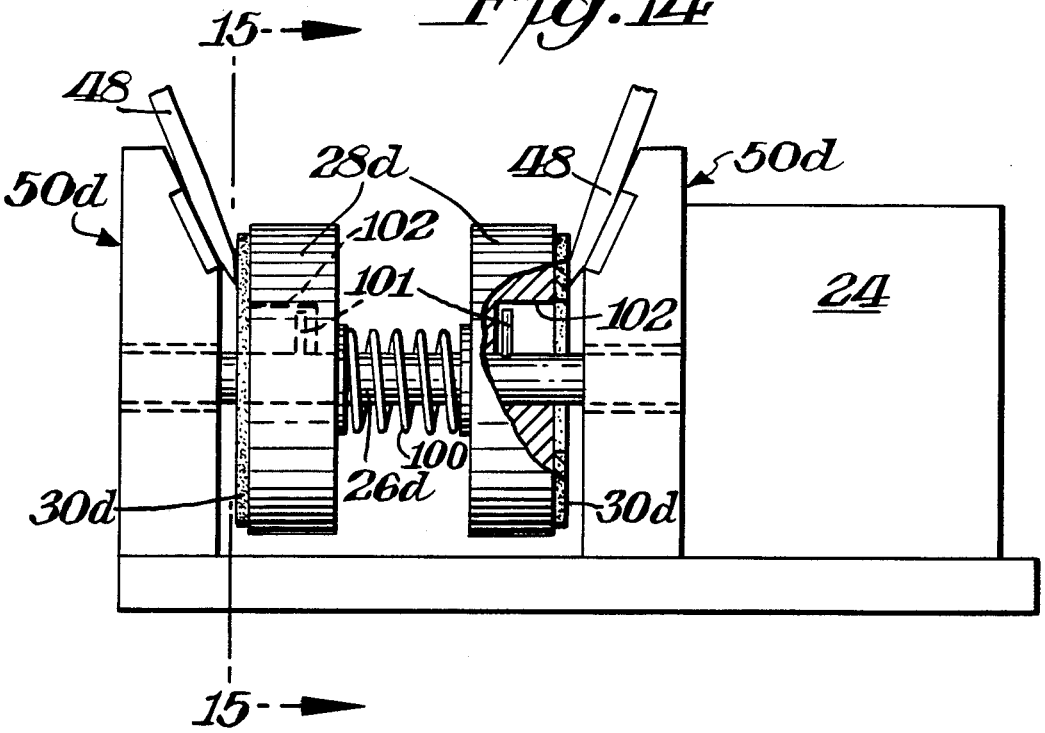
FIG. 14 is an elevation view of yet a further embodiment of this invention.
Figure 15:
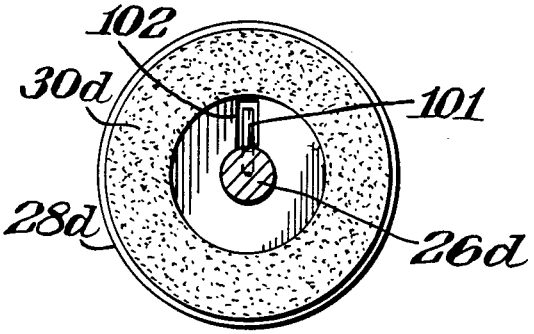
FIG. 15 is a cross-sectional view taken through FIG. 14 along the line 15—15.

FIGS. 14–15 show an alternative form of the invention using a split disk arrangement. The double disk design has proven particularly effective to permit the operator to sharpen conveniently both cutting edge facets of a knife from the same side of the sharpener. In this arrangement two disks **30*d*, 30*d* are secured and positioned back to back on a driven shaft 26*d* and held apart against stops in their rest positions by a biasing mechanism, such as spring 100, located between the two disks forcing the disks apart. Travel of each disk along the shaft axis is limited in one direction by the stop or pin 101 located on the shaft and in the other direction by the position of the second disk or the biasing mechanism. The permissible travel of each disk against the biasing mechanism and toward the opposite disk must be sufficient to avoid the possibility of the disk reaching its limit of travel against the biasing mechanism at any time while the knife being sharpened is displacing the disk against the biasing mechanism. The disks secured to the stops can slide independently on their common shaft while each is forced to rotate at the shaft speed by a pin 101 fastened to or through the shaft, that engages within a slotted portion 102 of the hub of each disk. The pin 101 also can serve as a stop to control position of the disks in this rest position. Other means of driving the disks at shaft speed while allowing the disks to slide on the shaft will be obvious to those skilled in mechanical arts. Abrasive mounted on the outside faces of each disk 30*d*, 30*d* rotating on the shaft 26*d*** is pressed against the knife cutting-edge facet during sharpening by a force determine by the spring or other biasing means. For a given knife and type abrasive, the rate of metal removal during sharpening depends on the biasing force and on the size and speed and number of the abrasive particles.

Although not illustrated in FIG. 14, it is to be understood that the stops 54 (FIG. 2) may be extended sufficiently toward the disks to prevent the knife blade from being inserted too far and to provide support for the vertical facet. Stops 54 thus would limit the degree of insertion of the knife and limit the displacement of the disk against the spring.

It has been discovered there is one particularly favorable arrangement of stops relative to the knife guide. When the stops are located physically directly opposite the guide, as for example in FIGS. 2 and 3 a severe wedging action can be encountered that binds the knife as its facets are wedged into the V created by the guide and stop. This wedging action can jam the knife and prevent smooth movement of the knife along the guide. This can lead to irregular and nonuniform sharpening action. Surprisingly this wedging action is eliminated or reduced to a negligible level if the stop is located at a position displaced laterally from the angle-controlling element of the guide mechanism. Only a small displacement is needed to avoid this problem.

Figure 16:
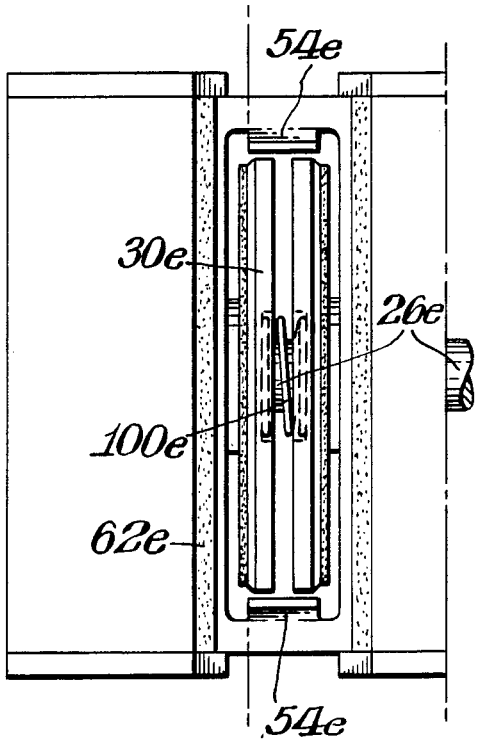
FIG. 16 is a partial top plan view of a slightly modified disk style sharpener according to this invention.
Figure 17:
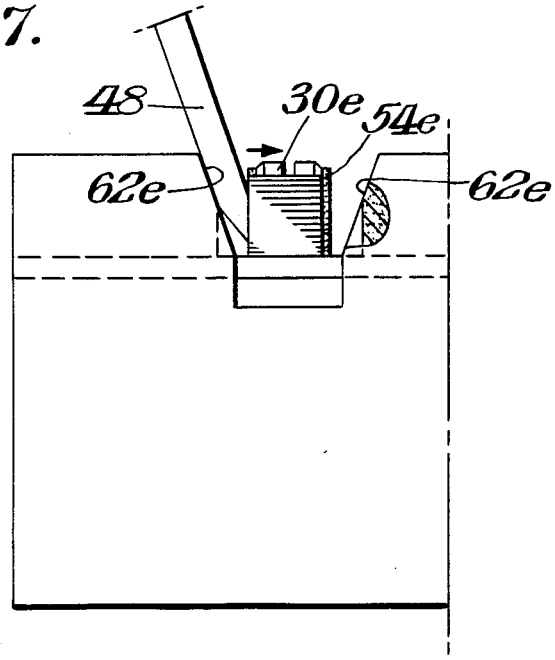
FIG. 17 is a side elevational view of the embodiment of the invention shown in FIG. 16.

FIGS. 16 and 17 illustrate stops **54*e* displaced laterally to positions that are not directly opposite the guide plane 62*e*. The stops 54*e* shown here are located physically just beyond the guide plane in a direction further from the shaft and beyond the perimeter of the abrasive disk 30*e* shown biased to its rest position on shaft 26*e* by spring 100*e*. As a knife face is moved down the guide plane 62*e*, the cutting edge facet comes into contact with the rotating abrasive disk 30*e*. As force is applied to the knife's cutting edge facet to move it to the right against the disk of FIG. 16, the disk is displaced to right against the biasing force of spring 100*e* until further movement of the cutting edge is limited by the stops 54*e***.

Forces can be applied to the knife and in turn to its cutting edge facet by magnetic forces on the knife that act along the guide lane, by the force of gravity acting on the mass of the knife by the operator physically applying added downward force on the knife or by the rotational action of the disk on the facet that forces the edge into the V and creates a force in the direction of the disk. These forces acting through that cutting edge facet which is in contact with the disk can displace the disk to the right against its biasing force until the cutting edge facet comes into contact with the stop. Clearly it is also possible to use a non linear biasing force acting against the disk in a manner so that the biasing force increases with displacement. In that situation the disk displacement will be determined either by (a) the extent of displacement necessary so that biasing force equals the total force applied to the cutting edge facet by the combination of all types of forces applied to the knife along the guide plane and in the direction of the disk or by (b) the stops if total force applied to the knife, and in turn to the facet, exceeds the biasing force at that point.

The invention may also be used by mounting any suitable number of disks on each shaft to achieve different types of abrading action such as coarse and fine or any intermediate treatments.

This invention may be embodied in other specific forms without departing from the spirit or essential characteristics thereof. The present embodiments and those described here are therefore to be considered in all respects as illustrative and not restrictive, the scope of the invention being indicated by the append claims rather than by the foregoing description, and all changes which come within the meaning and range of equivalency of the claims are therefore intended to be embraced therein.

What is claimed is:

1. A method of sharpening a knife having a face terminating at a cutting edge facet comprising providing a magnetic guide member having a magnetic guide surface juxtaposed an abrasive surface with the guide surface being in a plane disposed at a predetermined angle to and intersecting the abrasive surface to form a line of intersection therewith and with the magnetic guide surface having a pair of magnetic poles comprising a north pole and a south pole oriented such that each lies along a line which is substantially parallel to the line of intersection, locating the magnetic guide surface with one of the north and the south magnetic poles being disposed contiguous to the abrasive surface and having the other of the north and the south magnetic poles being disposed remote from the abrasive surface, imparting a motion to the abrasive surface, placing the knife against the magnetic guide member, and utilizing the magnetic field created by the magnetic poles to provide a thrust which moves the cutting edge facet into contact with the abrasive surface and a force to hold the cutting edge facet in contact with the abrasive surface while the abrasive surface is in motion.

2. The method of claim 1 wherein the abrasive surface is on a disk mounted to a rotatable shaft in a manner which permits displacement of the disk along the axis of rotation of the shaft, including the steps of rotating the abrasive disk, urging the abrasive disk toward the magnetic guide surface, and moving the face of the knife along the guide surface toward the abrasive surface until the knife displaces the abrasive surface away from the magnetic guide surface.

3. The method of claim 2 including removing the knife from contact with the rotating abrasive surface, providing a second sharpening member having an abrasive surface with abrasive elements in a second principal plane, driving the second abrasive surface by a drive means in a uniform, cyclical orbital motion, providing a second knife guide member rigidly fixed relative to the drive means and generally contiguous to the principal plane of the second abrasive surface with the second knife guide member forming a rigid second guide plane at a predetermined angle to the principal plane, placing the face of the knife in contact with the second knife guide member, moving the knife slidingly along the second guide plane, and utilizing the knife guide member to impart a continuous force to the face of the knife which holds the face of the knife against the guide member and urges and maintains the cutting edge into contact with the second abrasive surface.

4. The method of claim 3 wherein each abrasive element on the second abrasive surface is moved in an orbital path no greater than one inch at a velocity no greater that 800 feet per minute.

5. The method of claim 3 wherein the second knife guide member is magnetic guide surface with a pair of opposite polarity magnetic poles which create a magnetic field at the second abrasive surface and utilizing the magnetic field at the second abrasive surface to create the continuous force which holds the face of the knife and urges and maintains the cutting edge of the knife into contact with the second abrasive surface and which removes sharpening debris away from the second abrasive surface.

6. The method of claim 5 including holding the face of the knife at a lesser angle when the cutting edge is against the first abrasive surface than when against the second abrasive surface.

7. A method of sharpening a knife of finite mass having a face terminating at a cutting edge facet using a rotating disk affixed to a mounted shaft and displaceable against a biasing force, a first guide defining a guide plane, and a magnetic force means for applying a force to the knife along the guide plane toward the abrasive disk, said disk having an abrasive surface defining a principal plane perpendicular to the axis of rotating comprising the steps of fixing the position of the first guide rigidly relative to the mounted shaft and contiguous to the principal plane with the guide plane at a predetermined angle relative to the principal plane, positioning the face of the knife along the first guide, moving the knife slidingly along the first guide, urging the knife cutting edge facet into contact with the abrasive disk by subjecting the knife cutting edge facet to the magnetic force means and holding only the cutting edge facet in contact with the abrasive surface by the magnetic force means while the abrasive surface is in motion.

8. A method of sharpening a knife according to claim 7 which includes establishing the magnitude of the biasing force to be less than a combined thrust in the direction of the axis of the disk established by the magnetic force means and by the force of gravity acting on the mass of the knife and by any impact force imparted to the cutting edge facet by the rotating disk in the direction of the disk.

9. A method of sharpening a knife according to claim 8 which includes limiting the extent of the knife movement along the first guide toward the abrasive surface by controlling any disk displacement caused by the cutting edge facet and establishes the cutting edge facet in a position parallel to the principal plane of the disk.

* * * * *